United States Patent [19]

Grune

[11] 4,041,264

[45] Aug. 9, 1977

[54] OPERATING DEVICE FOR A CONTACT DEVICE FOR A PRE-INSERTION RESISTOR IN A HIGH-VOLTAGE CIRCUIT BREAKER

[75] Inventor: Per Olof Grune, Ludvika, Sweden

[73] Assignee: Asea Aktiebolag, Vasteras, Sweden

[21] Appl. No.: 611,323

[22] Filed: Sept. 8, 1975

[30] Foreign Application Priority Data

Sept. 30, 1974 Sweden ..... 7412254

[51] Int. Cl.[2] ..... H01H 33/54

[52] U.S. Cl. ..... 200/148 R; 200/82 B

[58] Field of Search ..... 200/148 D, 148 B, 148 R, 200/82 B

[56] References Cited

U.S. PATENT DOCUMENTS

| | | | |
|---|---|---|---|
| 2,964,605 | 12/1960 | Schulz | 200/82 B |
| 3,715,542 | 2/1973 | Grune et al. | 200/148 D |
| 3,748,418 | 7/1973 | Kawasaki | 200/82 B |

*Primary Examiner*—Robert S. Macon
*Attorney, Agent, or Firm*—Watson, Cole, Grindle & Watson

[57] ABSTRACT

For rapid on-off operation of a contact device for a pre-insertion resistor in a high voltage compressed gas circuit breaker, the operating device includes a piston movable in a cylinder and connected to a movable contact. The piston forms two spaces in the cylinder. A quick operating valve connects the first cylinder space alternately to a source of high pressure or to a low pressure space. The space on the other side of the cylinder can be connected through openings to a delay space which surrounds the cylinder in the form of a ring. A spring-mounted slide is provided in the cylinder for normally closing these openings but allowing them to open when the piston moves. The delay space is connected to the source of pressure fluid through a line containing a check valve which prevents outflow from the delay space.

3 Claims, 3 Drawing Figures

OPERATING DEVICE FOR A CONTACT DEVICE FOR A PRE-INSERTION RESISTOR IN A HIGH-VOLTAGE CIRCUIT BREAKER

BACKGROUND OF THE INVENTION

Field of the Invention

Upon closing a high-voltage circuit breaker, large overvoltages are often generated. In order to reduce these to a value which is harmless for the plant in question, pre-insertion resistors are used which are switched in immediately before closing the main contact device.

Summary of the Invention

The present invention relates to an operating device for the contact members used for switching in the pre-insertion resistors. These contact members must be capable of being switched in very quickly, and it must also be possible to switch them off after a very short time (20–30 ms). This is achieved with an operating device of a type which has a cylinder divided into two spaces by a piston, and surrounded by a delay space in the form of a ring, with openings between the delay space and the space on one side of the piston. The other side of the piston is supplied with gas under pressure, which at the same time is supplied to the delay space. A slide slidable in the cylinder normally closes the openings, but allows them to open upon movement of the piston. A check valve prevents flow from the delay space back to the fluid pressure source.

BRIEF DESCRIPTION OF THE DRAWINGS

The accompanying drawing shows an embodiment of an operating device according to the invention, FIGS. 1 and 2 showing the operating device when the resistor contacts are opened and closed, respectively, whereas

DESCRIPTION OF THE PREFERRED EMBODIMENTS

Figure 1:
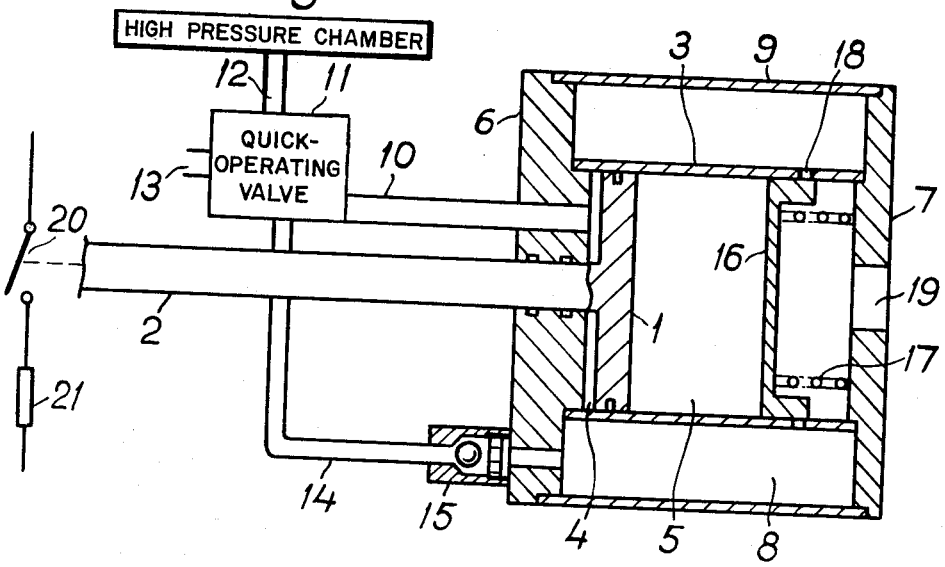

In the drawing, a piston 1 is connected by way of a piston rod 2, to the movable contact member in a contact device 20 for a pre-insertion resistor 21 in a high voltage circuit breaker (compressed air or sulphur hexafluoride circuit breaker). The piston 1 is movable in a cylinder 3 and limits a first cylinder space 4 to the left of the piston and a second cylinder space 5 to the right of the piston. Outwardly the cylinder spaces 4 and 5 are limited by a bottom plate 6 and a cover 7, respectively. The cylinder 3 is surrounded by an annular space 8, referred to below as the delay space, which is limited by an outer cylindrical casing 9. The cylinder space 4 is connected, by way of a tube 10, to a quick-operating valve 11. Through this valve the cylinder space 4 may be connected, on the one hand, to a connection conduit 12 to a chamber filled with high-pressure gas, and, on the other hand, to a valve opening 13, which opens out either in the free air or, in the case of a sulphur hexafluoride circuit breaker, into a low-pressure chamber. The delay space 8 can also be connected to the connection conduit 12 to the high-pressure chamber through a conduit 14 and the quick-operating valve 11. On the other hand, the space 8 cannot be evacuated through the quick-operating valve 11 since the conduit 14 is provided with a nonreturn valve 15.

In the cylinder space 5 there is arranged a slide 16 which is normally (that is, when the contact device 20 is opened) retained by a spring 17 in the lefthand end position shown in FIG. 1. The slide 16 is constructed so that it shuts off a number of connection openings 18, arranged in the cylinder 3, between the delay space 8 and the cylinder space 5. The space on the right-hand side of the slide 16 communicates freely with the surrounding through an opening 19.

The quick-operating valve 11 is electrodynamically operated and can be constructed in many different ways as shown, for example, in U.S. Pat. No. 3,715,542. FIG. 3 shows a preferred embodiment. The valve consists of a valve housing 22 provided with a bottom plate 23 and a lid 24. Between the lid 24 and the valve housing 22 a guiding member 25 is secured by bolts 26. The valve housing 22 contains a movable valve member 27 which is connected through a piston rod 28 to an electrodynamic operating device, not shown. The connection opening 12 of the valve is connected to a chamber which is constantly filled with high-pressure gas, whereas the valve openings 29 are connected to the connection conduits 10 and 14 shown in FIGS. 1 and 2. The valve has exhaust openings 13. The valve member 27 is displaceable between two end positions. In one (the lower) end position, the valve member seals against a valve seat 30 arranged around the connection opening 12 to the high-pressure chamber, the valve seat 30 enclosing an area $A_1$. In the other (the upper) end position, the valve member seals against a cylindrical surface 31 arranged in a channel leading to the exhaust openings 13. On the other side of the valve member 27 facing away from the connection opening 12, the valve member 27 is formed as a cylindricl cup, projecting in the operating direction, the internal cylinder surface of which, has an area $A_2$, and seals against a peg 32, provided with a collar, on the guiding member 25. The space 33 which is thus limited by the end surface of the peg 32 and the valve member 27 is in permanent communication with the high-pressure chamber through openings 34.

Through the upper part of the piston rod 28, the valve member 27 is connected to a return piston 35, by means of which the valve member 27 can be returned from its upper to its lower end position by pressurizing the space above the piston 35. A spring 36 biases the return piston in a downward direction. The piston rod 28 slides in a central hole 37 in the guiding member 25. The cross-sectional area of the hole 37 is $A_3$.

In the lower end position of the valve, the sealing pressure against the valve seat 30 is achieved through the pressure on the surface ($A_2$ - $A_1$ - $A_3$) and by the spring 36.

When the circuit breaker is to be closed, the contact device 20 is operated in the following manner:

The valve member 27 in the quick-operating valve 11 is operated by discharging a capacitor through an induction coil in the electrodynamic operating device, not shown, so that the valve member 27 is moved to its upper end position. Through the valve openings 29, pressure is applied simultaneously to the cylinder space 4 through the tube 10 and to the delay space 8 through the tube 14. When this causes the piston 1 to move, the gas in the cylinder space 5 is compressed. The increase in pressure which then arises affects the spring-loaded slide 16 and moves this slide so that the holes 18 are exposed and a connection is formed between the spaces 5 and 8. By arranging the slide 16 so that the holes 18 are exposed before the piston 1 has made its full stroke, a gas damping of the piston 1 will have time to develop by compression of the pressurized gas in front of the piston.

Figure 2:
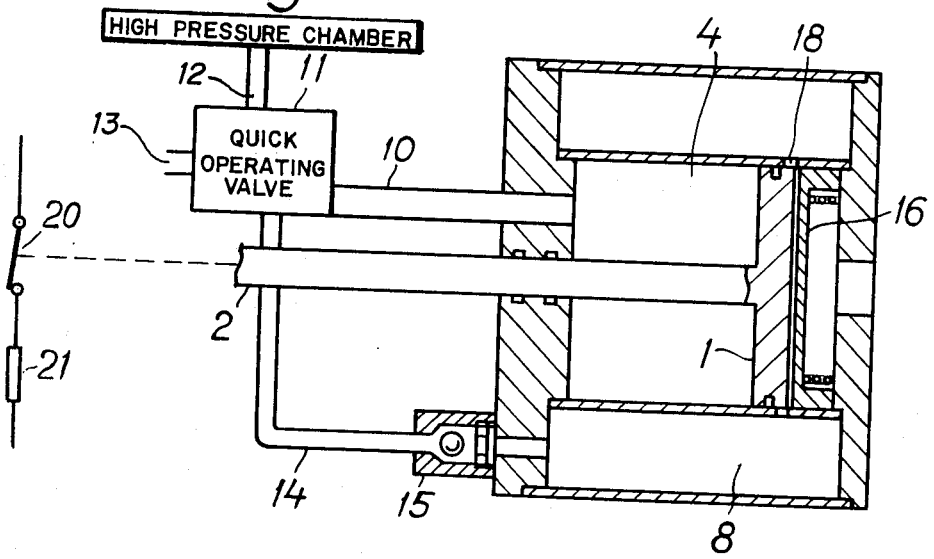
Figure 3:
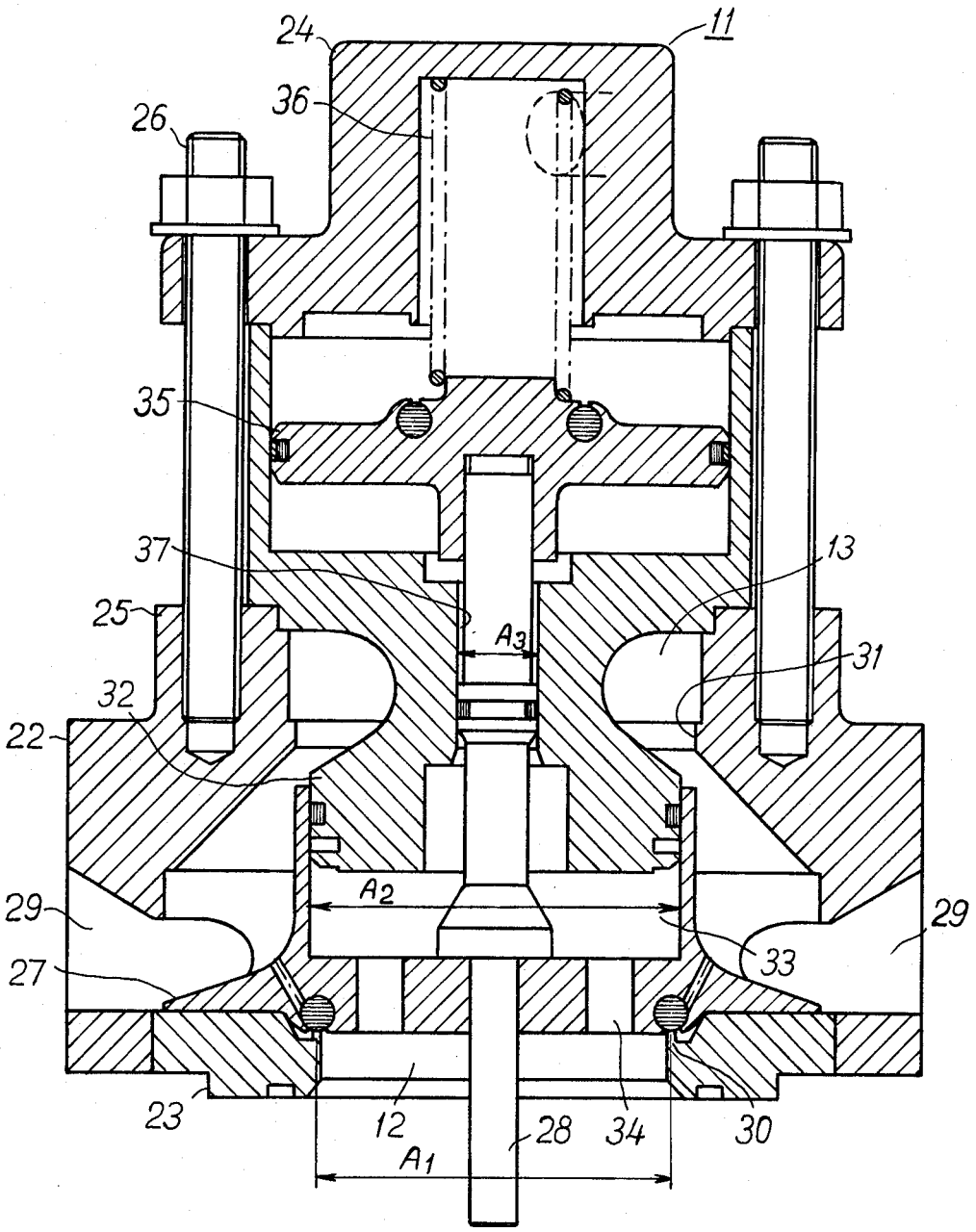
FIG. 3 shows a quick-operating compressed gas valve for such a device.

To make the piston 1 return, the gas in the cylinder space 4 is evacuated through the tube 10 (FIG. 2). The evacuation of the gas in the delay space 8 is prevented by the nonreturn valve 15. The pressure which is thus maintained in the delay space 8 operates on the piston 1 through the holes 18 so that the piston 1 returns to its original position.

The invention is not limited to the embodiment shown. For example, when the demands for a short times between closing and opening are not so great, it is possible to exclude the slide 16 and to use a lid 17 without the hole 19. However, for this the area ratio between the tube 14 and the holes 18 must be correctly adjusted.

I claim:

1. An operating device for rapid On-Off operation of a contact device having a movable contact for a preinsertion resistor in a high-voltage compressed gas circuit breaker, which operating device comprises a high pressure chamber, a cylinder, a piston (1) movable in the cylinder (3) and connected to the movable contact of said contact device, one side of said piston limiting a first cylinder space (4), a quick-operating control valve (11) for connecting said first cylinder space alternatively to said high-pressure chamber for closing the contact device and to a low-pressure space for opening the contact device, the other side of the piston (1) limiting a second cylinder space (5), a delay space, at least one opening which, at least during the latter stage of the contact operation, connects the delay space (8) with the second cylinder space, said control valve including means to connect said delay space (8) to the high-pressure chamber to be supplied with high-pressure gas substantially simultaneously with pressurizing said first cylinder space (4), and a non-return valve in the connection between the delay space (8) and the control valve (11).

2. An operating device according to claim 1, having in said second cylinder space (5) a spring-loaded slide (16), for closing said opening (18) between said second cylinder space (5) and the delay space (8) during the first stage of the contact operation.

3. An operating device according to claim 1, in which the delay space (8) surrounds said cylinder (3) in the form of a ring.

* * * * *